US012123203B2

(12) United States Patent
De Rick

(10) Patent No.: US 12,123,203 B2
(45) Date of Patent: Oct. 22, 2024

(54) FLOOR PANEL FOR FORMING A FLOOR COVERING

(71) Applicant: FLOORING INDUSTRIES LIMITED, SARL, Bertrange (LU)

(72) Inventor: Jan De Rick, Geraardsbergen (BE)

(73) Assignee: UNILIN, BV, Wielsbeke (BE)

( * ) Notice: Subject to any disclaimer, the term of this patent is extended or adjusted under 35 U.S.C. 154(b) by 282 days.

(21) Appl. No.: 17/764,620

(22) PCT Filed: Oct. 2, 2020

(86) PCT No.: PCT/IB2020/059238
§ 371 (c)(1),
(2) Date: Mar. 29, 2022

(87) PCT Pub. No.: WO2021/070022
PCT Pub. Date: Apr. 15, 2021

(65) Prior Publication Data

US 2022/0341187 A1 Oct. 27, 2022

(30) Foreign Application Priority Data

Oct. 8, 2019 (BE) ..... 2019/5659

(51) Int. Cl.
*E04F 15/02* (2006.01)

(52) U.S. Cl.
CPC *E04F 15/02038* (2013.01); *E04F 2201/0123* (2013.01); *E04F 2201/0146* (2013.01);
(Continued)

(58) Field of Classification Search
CPC ..... E04F 15/02038; E04F 2201/0123; E04F 2201/0146; E04F 2201/0161;
(Continued)

(56) References Cited

U.S. PATENT DOCUMENTS 6,769,219 B2 8/2004 Schwitte et al.
8,375,673 B2 * 2/2013 Evjen ..... E04F 15/04 52/592.1

(Continued)

FOREIGN PATENT DOCUMENTS

CN 1910327 A 2/2007
CN 101910528 A 12/2010

(Continued)

OTHER PUBLICATIONS

International Search Report with Written Opinion from PCT Application No. PCT/IB2020/059238, Jan. 28, 2021.

(Continued)

*Primary Examiner* — Brent W Herring
(74) *Attorney, Agent, or Firm* — Workman Nydegger

(57) ABSTRACT

A floor panel contains opposite edges that contain coupling parts to link two floor panels. These coupling parts contain locking planes: first and second locking planes on the first edge with an enclosed angle between 90° and 175°; and third and fourth locking planes on the second edge with an enclosed angle between 90° and 175°. The first locking plane is closer to the top of the floor panel than the second locking plane. The angle with the surface of the floor panel of the first locking plane is smaller than the second locking plane. The angle with the floor plane surfaces of the third locking plane is smaller than that of the fourth locking plane. The second locking plane is provided for interaction with the fourth locking plane of a coupled panel. The first locking plane is provided for interaction with the third locking plane of a coupled panel.

16 Claims, 4 Drawing Sheets

(52) U.S. Cl.
CPC . *E04F 2201/0161* (2013.01); *E04F 2201/023* (2013.01); *E04F 2201/042* (2013.01); *E04F 2201/043* (2013.01)

(58) Field of Classification Search
CPC ..... E04F 2201/023; E04F 2201/042; E04F 2201/043; E04F 2201/0115; E04F 2201/0153; E04F 15/107
See application file for complete search history.

(56) References Cited

U.S. PATENT DOCUMENTS

| | | | | |
|---|---|---|---|---|
| 8,499,521 | B2 | 8/2013 | Pervan et al. | |
| 8,978,335 | B2 | 3/2015 | Kiefel et al. | |
| 9,670,683 | B2 | 6/2017 | Cappelle | |
| 11,873,647 | B2 | 1/2024 | De Rick et al. | |
| 11,946,261 | B2 | 4/2024 | Boucke et al. | |
| 2003/0163968 | A1* | 9/2003 | Nel | F16B 5/0008 52/589.1 |
| 2004/0200175 | A1 | 10/2004 | Weber | |
| 2004/0250492 | A1 | 12/2004 | Becker | |
| 2005/0166514 | A1* | 8/2005 | Pervan | B27M 3/04 52/578 |
| 2008/0245020 | A1* | 10/2008 | Kiefel | E04F 13/08 52/588.1 |
| 2009/0133353 | A1* | 5/2009 | Pervan | H01F 7/122 52/747.1 |
| 2010/0293879 | A1* | 11/2010 | Pervan | H01F 7/0252 52/588.1 |
| 2012/0066996 | A1* | 3/2012 | Konstanczak | E04F 13/08 52/588.1 |
| 2015/0337542 | A1* | 11/2015 | Cappelle | E04F 15/10 52/309.1 |
| 2017/0241136 | A1 | 8/2017 | Kell | |
| 2018/0266121 | A1 | 9/2018 | Meersseman et al. | |
| 2018/0305937 | A1* | 10/2018 | Cappelle | E04F 15/02 |
| 2019/0211569 | A1 | 7/2019 | Boo et al. | |
| 2020/0340254 | A1* | 10/2020 | De Rick | E04F 15/10 |
| 2021/0310256 | A1* | 10/2021 | Boo | E04F 13/0894 |
| 2022/0412101 | A1* | 12/2022 | De Rick | E04F 15/105 |
| 2023/0175260 | A1* | 6/2023 | Boo | E04C 2/40 52/578 |
| 2023/0175272 | A1* | 6/2023 | Cappelle | E04F 15/02033 52/588.1 |

FOREIGN PATENT DOCUMENTS

| | | | |
|---|---|---|---|
| CN | 104847087 | A | 8/2015 |
| CN | 105178554 | A | 12/2015 |
| CN | 108474211 | A | 8/2018 |
| CN | 110043001 | A | 7/2019 |
| DE | 102009019492 | A1 | 11/2010 |
| DE | 202016102034 | U1 | 5/2016 |
| WO | 9747834 | A1 | 12/1997 |
| WO | 0198603 | A2 | 12/2001 |
| WO | 2004074597 | A1 | 9/2004 |
| WO | 2006032398 | A1 | 3/2006 |
| WO | 2016046800 | A1 | 3/2016 |

OTHER PUBLICATIONS

Belgian Search Report from corresponding BE Application No. 201905659, Jun. 16, 2020.

* cited by examiner

FLOOR PANEL FOR FORMING A FLOOR COVERING

BACKGROUND

The present invention relates to a floor panel for the forming of a floor covering, in particular for the forming of a floor covering which can be installed on a surface.

More specifically, the invention relates to floor panels provided on at least two opposite edges with coupling parts that allow the floor panels to be mechanically coupled. Examples of such floor panels are described for instance in WO97/47834, WO01/98603, U.S. Pat. No. 6,769,219, WO2006/032398 and WO 2004/074597.

The purpose of the invention is to provide floor panels that can be more easily coupled— in other words with less force—when installing the floor covering.

SUMMARY

To this end, the invention relates to a floor panel for the forming of a floor covering. This floor panel comprises a substrate and a decorative layer. The floor panel is rectangular, either oblong or square, so it contains a first pair of opposite edges and a second pair of opposite edges. The first pair of opposite edges contains first coupling parts that allow several of such floor panels to be coupled together. These first coupling parts constitute a first locking system which, in a coupled condition of two such floor panels, creates a locking in the plane of the floor panels and perpendicular to the relevant edges, and also a second locking system which, in a coupled condition of two such floor panels, creates a locking across the panel face. These first coupling parts are mainly in the material of the floor panel itself, and preferably in said substrate. For the first locking system to be achieved, these first coupling parts contain locking parts which, in the coupled condition, prevent the first coupling parts from sliding apart. Said locking parts are provided with locking planes. The locking part of the coupling part on the first edge of the first pair of opposite edges contains a first and a second locking plane. The first and second locking planes are adjacent, while the first locking plane and the second locking plane form a convex part of the coupling parts to which these locking planes belong. Between the first and second locking planes there is an enclosed angle between 90° and 175°. Preferably, this enclosed angle is greater than 100°, more preferably greater than 120°, more preferably greater than 140°. Preferably, the first locking plane and the second locking plane are separated by a bending line or a curved bending plane. The locking part of the coupling part on the second edge of the first pair of opposite edges contains a third and a fourth locking plane. The third and fourth locking planes are adjacent. The third locking plane and the fourth locking plane form a concave part of the coupling part to which these locking planes belong. Between the third and fourth locking planes there is an enclosed angle between 90° and 175°. Preferably, this enclosed angle is greater than 100°, more preferably greater than 120°, more preferably greater than 140°. Preferably, the third and fourth locking planes are separated by a bending line or a curved bending plane. The first locking plane is closer to the top of the floor panel than the second locking plane. The angle between the first locking plane and the floor panel surface is smaller than the angle between the second locking plane and the floor panel surface. The angle between the third locking plane and the floor panel surface is smaller than the angle between the fourth locking plane and the floor panel surface.

The second locking plane is provided for interaction with the fourth locking plane of a coupled similar panel. The first locking plane is provided for interaction with the third locking plane of a coupled similar panel.

It is not necessary to have contact between the first and third locking planes on the one hand and/or between the second and fourth locking planes on the other hand in coupled condition of the panels. Clearance between locking planes may be have been provided for interaction with each other. However, from a certain load in the horizontal direction of the coupling between the coupled panels, contact will occur between locking planes for interaction with each other, possibly due to an elastic or even plastic deformation of coupling parts. Preferably, in coupled condition, there is contact between the second and the fourth locking planes or, under load in a horizontal direction, the first contact will be made between the second and the fourth locking planes and only if there is further load between the first and third locking planes. However, it is not impossible that, in the coupled condition of two panels, there is contact between the first and the third locking planes as well as between the second and the fourth locking planes.

Floor panels according to the invention can be installed more easily, because less force must be overcome to mechanically couple the first coupling parts—so two panels—together; yet the coupling strength will still be sufficiently high. This means that the pulling force required to pull coupled panels apart horizontally, is still sufficiently high.

Preferably, the angle between the first locking plane and the floor panel surface is at least 10°—and preferably less than 20°—smaller than the angle between the second locking plane and the floor panel surface. Such embodiments reduce the force required to mechanically couple the first two coupling parts—so two panels—together, while still creating proper coupling between the panels in a horizontal direction. This means that the pulling force required to pull coupled panels apart horizontally, is still sufficiently high.

Preferably, the angle between the third locking plane and the floor panel surface is at least 10°—and preferably less than 20°—smaller than the angle between the fourth locking plane and the floor panel surface. Such embodiments reduce the force required to mechanically couple the first two coupling parts—so two panels—together, while still creating proper coupling between the panels in a horizontal direction. This means that the pulling force required to pull coupled panels apart horizontally, is still sufficiently high.

Preferably, the first, second, third, and fourth locking planes are all located in the lower half of the floor panel thickness. This additionally facilitates the mechanical coupling of two panels.

Preferably, the area of the first boundary plane is larger than the area of the second boundary area. Such embodiments will even further reduce the force required to mechanically couple two such panels together.

Preferably, the area of the second boundary plane is at least one third, preferably at least half, of the area of the first boundary plane. Such embodiments offer a balance between on the one hand mechanically coupling the panels with low force, while on the other hand the coupling is sufficiently strong in the horizontal direction.

Preferably, the area of the third boundary plane is larger than the area of the fourth boundary plane. Such embodiments will even further reduce the force required to mechanically couple two such panels together.

Preferably, the area of the fourth boundary plane is at least one third, preferably at least half, of the area of the third boundary plane. Such embodiments offer a balance between on the one hand mechanically coupling the panels at low force, while on the other hand the coupling is sufficiently strong in the horizontal direction.

In advantageous embodiments of the invention, the enclosed angle between the first and the second locking planes is smaller than the enclosed angle between the third and fourth locking planes. In such embodiments the tolerances on production of the first coupling parts may be compensated, while still panels are realized that can more easily be installed while a coupling with sufficient tensile strength in the horizontal direction of the coupling is realized.

Preferably, the difference between on the one hand the angle between the first locking plane and the floor panel surface and on the other hand the angle between the third locking plane and the fourth panel surface is greater than the difference between on the one hand the angle between the second locking plane and the floor panel surface and on the other hand the angle between the fourth locking plane and the floor panel surface. The advantage of such embodiments is that on a horizontal load of the coupling, there is contact or contact initially happens between the second and the fourth locking plane, and only after that between the first and the second locking plane. Since the second locking plane is more vertical than the first one, this means a higher resistance of the coupling against horizontal loads.

Preferably, the difference between on the one hand the angle between the second locking plane and the floor panel surface and on the other hand the angle between the fourth locking plane and the floor panel surface in an absolute value is smaller than 3°, preferably in absolute value smaller than 2°. Such embodiments ensure that, when coupled, there is a secured contact between the second and fourth locking planes, rather than directly between the first and second locking planes. This is useful to obtain high values of the tensile strength with which the panels are coupled in a horizontal direction.

Preferably, the coupling part on the first edge of the first pair of opposite edges contains a horizontal-facing lip—preferably at the underside of the floor panel—and an upward-facing hook at the distal end of the lip. Here, the first and the second locking plane are located on the inside of this upward-facing hook. More preferably, the horizontal line in the vertical direction is centered between the first and the second locking plane in the lower half of the distance between the highest point of the upward-facing hook and the lowest point of the top of the lip. More preferably, this line is located in the lower 40% of the distance between the highest point of the upward-facing hook and the lowest point of the upper lip.

In preferred embodiments, the first coupling parts are configured to allow two such panels to be coupled together on these edges by means of a tilting motion and/or by means of horizontal sliding.

Preferably, the angle between the second locking plane and the floor panel surface is between 48° and 72°, more preferably this angle is greater than 55°. More preferably, this angle is less than 65°. Such embodiments provide sufficient strength in the horizontal direction of the coupling.

Preferably, the first coupling parts are made up of a tongue and a groove containing the locking parts. Preferably, the first coupling parts are configured to allow two such floor panels to be mechanically coupled at these edges by means of horizontal sliding and/or by means of tilting. Such horizontally coupling floor panels according to the invention can be slid together horizontally with less effort, i.e. with less force.

Preferably, in embodiments in which the coupling parts consist of a tongue and a groove containing the locking parts, on the first pair of opposite edges the groove is bordered by a lower lip and an upper lip—more preferably the lower lip extends sideways beyond the distal end of the upper lip—and the lower lip contains an upward-facing hook at its distal end. The first and the second locking plane are located on the inside of this upward-facing hook.

Preferably, the lower lip in coupled condition is at least partially elastically bent and thus produces a clamping force which forces the coupled floor panels together; while the floor panels are pressed together on or close to the floor panel surfaces. This provides a stronger coupling of the floor panels.

Preferably, the first coupling parts are configured so that in coupled condition the horizontal distance between on the one hand the vertical line through the center in a vertical direction between the first and the second locking planes and on the other hand the plane on or near the surface of the coupled panels where the coupled panels form a sealed locking, is smaller than 5.5 mm, more preferably smaller than 5 mm, more preferably smaller than 4 mm. Typically, floor panels with such short first coupling parts require a higher coupling force than floor panels with longer first coupling part. The invention ensures that such panels with short first coupling parts can still be mechanically coupled with less effort (i.e. by applying less force), while the strength of the coupling in the horizontal direction is still up to sufficient.

In an embodiment of the invention, the floor panel is oblong, and the first pair of opposite edges are on the long sides of the floor panel.

In an embodiment of the invention, the floor panel is oblong, and the first pair of opposite edges are on the short sides of the floor panel.

Preferably, the second pair of opposite edges contain second coupling parts that allow several of such floor panels to be coupled together. At the second pair of opposite edges, these second coupling parts constitute a third locking system which, when two of such floor panels are coupled, creates a lock in the plane of the floor panels and perpendicular to said edges, and also a fourth locking system which, when two of such floor panels are coupled, creates a lock across the plane of the panels. These second coupling parts at the second pair of opposite edges are mainly realized in the material of the floor panel itself, and more specifically in said substrate.

Preferably, the second coupling parts at the second pair of edges are configured to allow coupling of two such panels by means of a tilting motion and/or by means of horizontal sliding.

Preferably, the second coupling parts at the second pair of edges are configured to allow coupling of two of such panels at these edges by means of horizontal sliding.

Preferably, the second coupling parts at the second pair of edges are configured to allow coupling of two of such floor panels at these edges by means of a downward motion of one panel relative to the other one. In combination with the embodiments in which the first coupling parts are configured to allow coupling of these first coupling parts by means of a tilting motion, such floor panels can be installed to form a floor covering by means of what is known as "fold-down" motion.

In preferred embodiments of the invention in which second coupling parts at the second pair of edges are configured to allow coupling two such floor panels at the these edges by means of a downward motion of one panel relative to the other one, said second coupling parts are formed substantially from the material of said substrate and configured as one whole with it. The third locking system is at least formed from a downward-facing upper hook-shaped section located on one edge of said pair of opposite edges, and also from an upward-facing lower hook-shaped section located on the other opposite edge of said pair of opposite edges. The hook-shaped parts may be hooked together by means of said downward motion. Said hook-shaped part consists of a lip with a downward-facing locking element, while said upper hook-shaped part consists of a lip with an upward-facing locking element.

In embodiments as described in the previous section, the fourth locking system should preferably contain, in at least one or more coupling parts, one or more protrusions that engage in one or more undercuts in the other of the second coupling parts of the coupled floor panel.

Preferably, in the fourth locking system a separate locking part is provided by means of a movable and/or deformable insert that provides a vertical locking with the insert engaging in undercuts in both coupled edges of coupled floor panels.

Preferably, the second coupling parts at the second pair of edges have the characteristics as described in any embodiment for the first coupling parts. Such floor panels allow both pairs of edges to be coupled with less force, while still obtaining a sufficiently strong horizontal coupling. More preferably, the panel is oblong, and the second pair of opposite edges is located on the short side of the floor panel. Even more preferably, the angle with the surface of the floor panel of the second locking plane of the first coupling parts is smaller—and preferably at least 5° smaller—than the angle with the surface of the floor panel of the second locking plane of the second coupling parts. Such floor panels are particularly interesting. The second coupling parts are located at the short side of the floor panel. The force per unit of length to be coupled is higher on the short side than on the long sides, because of the higher angle of the second locking plane of the second coupling parts than the angle of the second locking plane of the first coupling parts. Because of the (much) smaller length to be coupled on the short side of the floor panel, this is not a disadvantage (the total force required to couple is equal to the force per unit of length to be coupled multiplied by the length to be coupled), while a higher strength is obtained in the horizontal direction of this coupling at the short side. It should also be noted that the edges of floor panels are never completely straight, which requires additional coupling force. Such irregularities are more likely to occur on the long side, which makes it interesting to design the configuration of the coupling parts at the pair of edges at the side in such a way that less force is required to couple them.

The floor panel substrate is preferably made up of several layers.

Preferably, the floor panel is substantially composed of one or more base layers and at least one top layer.

The floor panel should preferably contain a laminate panel with the substrate comprising either MDF (Medium Density Fiberboard) or comprising HDF (High Density Fiberboard).

In a preferred embodiment, the floor panel is an engineered-wood panel.

Preferably, the floor panel is more than 4.5 mm thick.

In a preferred embodiment, the floor panel is a resilient floor panel, preferably of the flexible type.

Flexible floor panels refers to floor panels for which it applies that when, in the case of a rectangular panel, for example less than 50 centimeters wide, they are clamped on one of the short sides of the panel, extending over a length of 100 centimeters and not supported, the panels deflect under their own weight, with a deflection of at least 10 centimeters at the free end relative to the clamped end. For this deflection, a deflection time of 10 seconds is considered, starting from that horizontal position of the panel.

A flexible or resilient synthetic floor panel according to the invention, and more specifically such a vinyl tile, preferably has one of the following characteristics:

- the floor panel is composed mainly of one or more base layers and at least one top layer, with the top layer in itself or may not be composed of several layers,
- the top layer contains at least one decorative layer, preferably in the form of a print, preferably applied on foil or film;
- the top layer comprises at least a translucent or transparent wear layer,
- the floor panel is mainly composed of a thermoplastic material, preferably of a soft thermoplastic material,
- the floor panel, or at least one or more of its base layers, is/are substantially made up of polyvinyl chloride, more specifically of soft polyvinyl chloride, more specifically provided with plasticizers or the like; a composition "substantially" based on PVC should be interpreted widely since a large number of additives, such as filling agents, can be used in PVC floors;
- the floor panel contains at least one reinforcement layer, preferably made from fibers, more special reinforcing fibers, such as glass fibers.

It should be noted that "soft PVC" is a term that expresses the fact that it refers to flexible PVC, in other words PVC that is relatively easily bendable. The concept of soft PVC is commonly known in the technique. This soft PVC consists of PVC that has been plasticized, preferably by plasticizers added during the production process. Depending on the quantity of added plasticizer, different degrees of flexibility may be achieved.

A plasticizer shall be understood to mean any substance which results in a more flexible PVC when added. Typical examples include phthalate plasticizers and isosorbide plasticizers.

PVC that has been plasticized, may of course also include PVC, or a compound based on PVC, which, for example because it has been modified, has the characteristic of being flexible in itself.

Preferably, the substrate comprises a thermoplastic matrix material, preferably polyvinyl chloride (PVC)— more preferably the substrate comprises a layer comprising foamed PVC, polypropylene (PP) or polyethylene (PE). More preferably, the substrate contains one or more filling agents, preferably selected from the list of stone, wood fiber, chalk, limestone and lime. The substrate is preferably provided with at least one reinforcement layer, preferably of fiberglass.

In a preferred embodiment, the floor panel is a Luxury Vinyl Tile (LVT).

In a preferred embodiment, the floor panel is a Stone Plastic Composite (SPC) or a Wood Plastic Composite (WPC).

Preferably, a floor panel, according to the invention of the resilient type or of the flexible type, has a thickness of less than or equal to 4.5 millimeters; more preferably less than or equal to 4 millimeters.

BRIEF DESCRIPTION OF THE DRAWINGS

In order to show the characteristics according to the invention, some embodiments are described below, with reference to the accompanying figures, in which FIG. 1 schematically shows a top view of a floor panel according to the invention.

Equal elements are shown in the various figures with the same reference number.

DETAILED DESCRIPTION OF VARIOUS EMBODIMENTS

Figure 1:
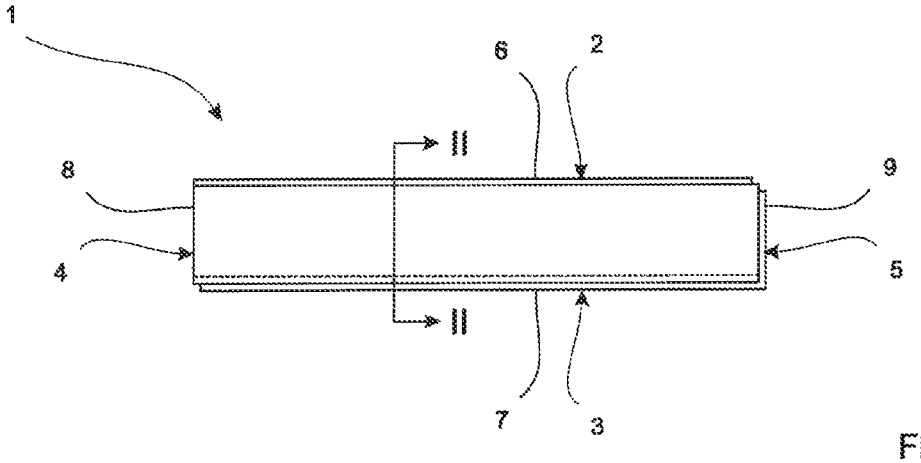
Figure 2:
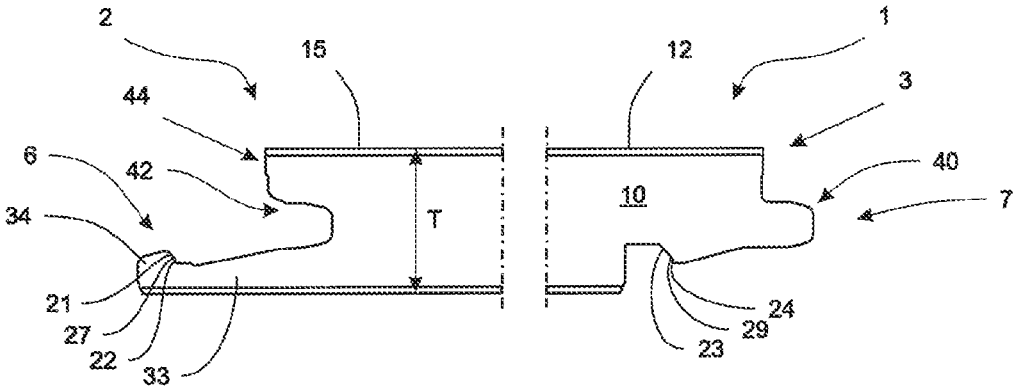
FIG. 2 shows the cross-section according to line II-II of the floor panel according to the invention of FIG. 1.
Figure 3:
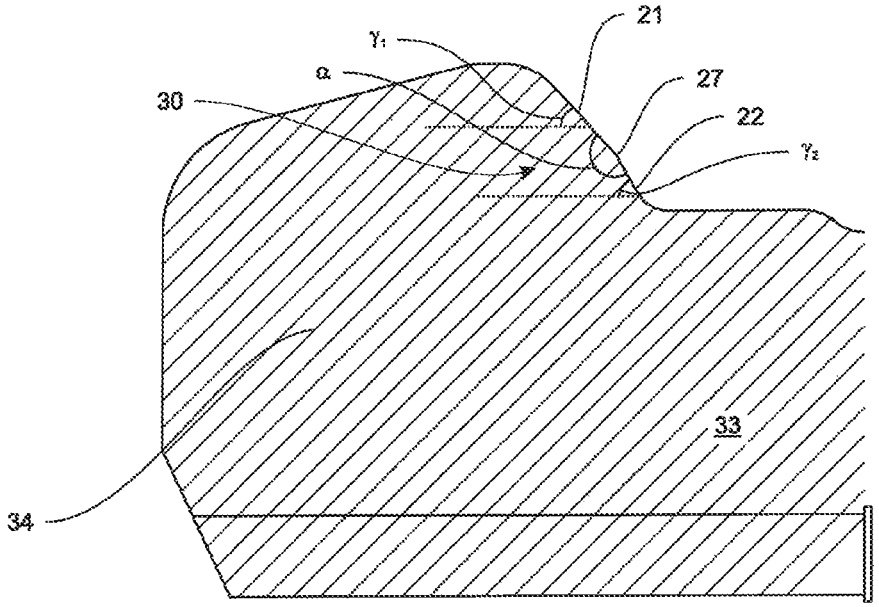
FIGS. 3 and 4 show details of coupling parts of the floor panel of FIGS. 1 and 2.
Figure 4:
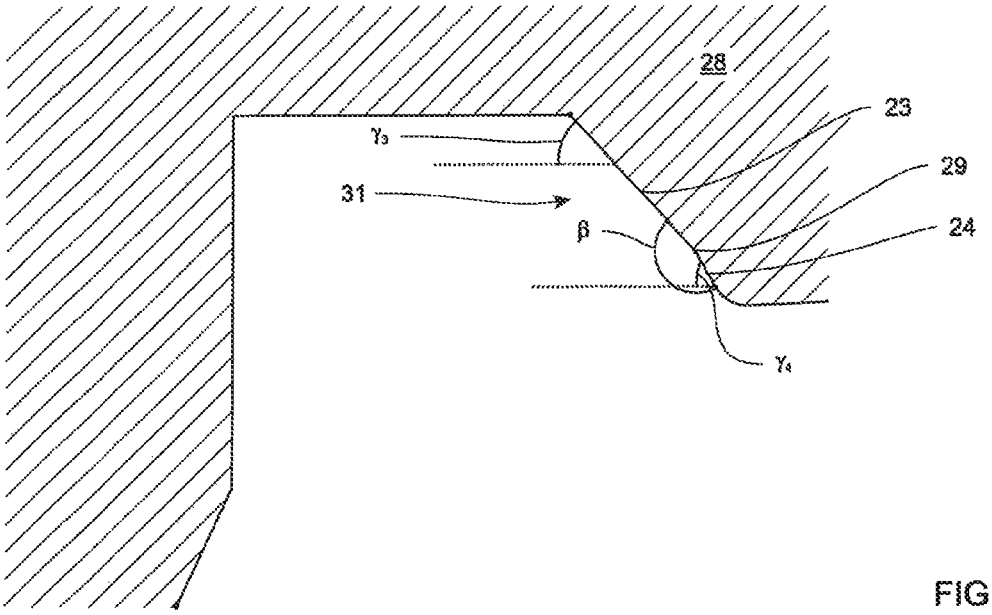
Figure 5:
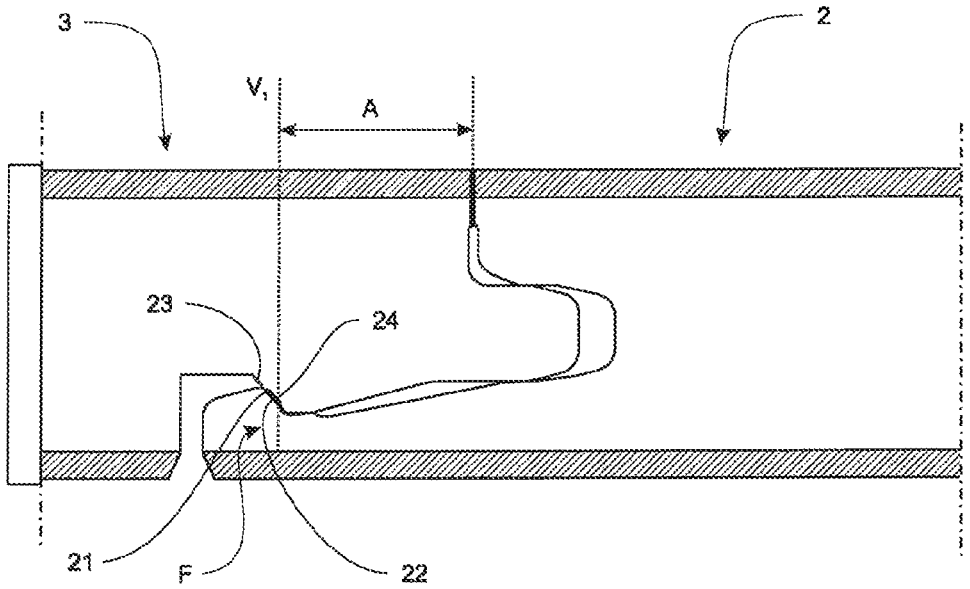
FIG. 5 shows two floor panels in coupled condition according to FIGS. 1 and 2.
Figure 6:
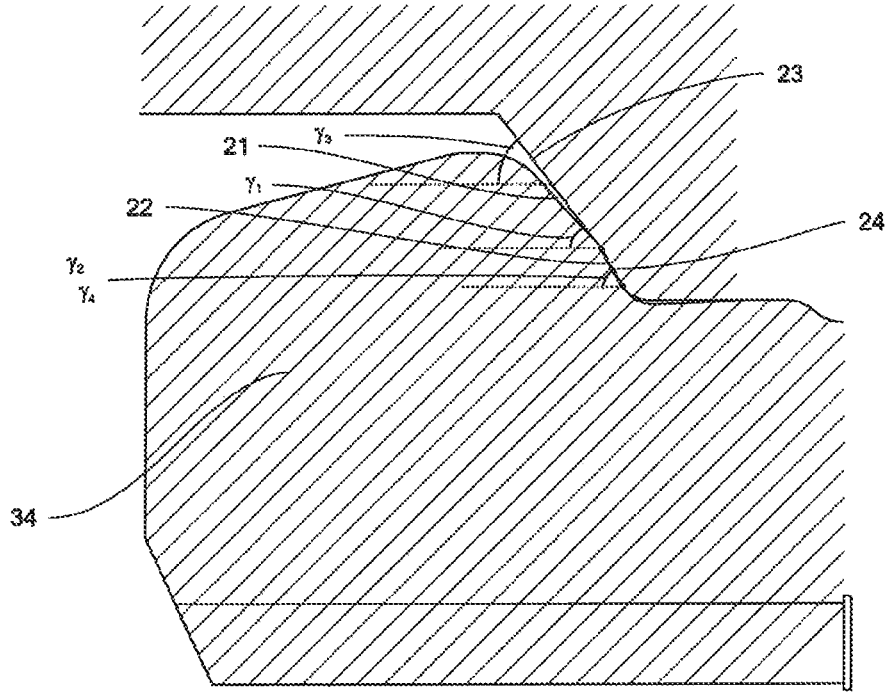
FIG. 6 shows a detail of the coupling of FIG. 5.

FIG. 1 schematically shows a top view of a floor panel according to the invention. FIG. 2 shows the cross-section according to line II-II of the floor panel according to the invention of FIG. 1. FIGS. 3 and 4 show details of the coupling parts of the floor panel of FIGS. 1 and 2. FIG. 5 shows two floor panels according to FIGS. 1 and 2 in coupled condition. FIG. 6 shows a detail of the coupling of FIG. 5.

The floor panel (1) illustrated in FIGS. 1-8 is a floor panel for the forming of the floor covering. The floor panel has a thickness T. This floor panel (1) contains a substrate (10)—for example of HDF (High Density Fiberboard) and a decorative layer (12). The floor panel (1) in the example is rectangular. It has a first pair of opposite edges (2, 3) and a second pair of opposite edges (4, 5). The first pair of opposite edges (2, 3) contains first coupling parts (6, 7) which allow several of these floor panels (1) to be coupled together, as shown in FIG. 5, by means of tilting motion or by means of horizontal sliding the coupling parts into each other.

These first coupling parts (6, 7) constitute a first locking system which, in a coupled condition of two such floor panels, creates a locking in the plane of the floor panels and perpendicular to the relevant edges, and also a second locking system which, in a coupled condition of two such floor panels, creates a locking across the panel face. These first coupling parts (6, 7) are created in the substrate (10).

For the first locking system to be achieved, these first coupling parts (6, 7) contain locking parts which, in the coupled condition, prevent the first coupling parts from sliding apart. The first coupling parts consist of a tongue (40) and a groove (42) containing the locking parts. These first coupling parts (tongue 40 and groove 42) are configured to allow two of such floor panels to be mechanically coupled to these edges by means of horizontal sliding and also by means of tilting. The groove (42) is bounded at the first pair of opposite edges by a lower lip (33) and an upper lip (44). The lower lip (33) extends sideways beyond the distal end of the upper lip (44). The lower lip (33) has an upward-facing hook (34) at its distal end.

The locking parts are fitted with locking planes (21, 22, 23, 24). The locking part of the coupling part (6) at the first edge (2) of the first pair of opposite edges contains a first (21) and a second (22) locking plane. The first (21) and second (22) locking planes are located on the inside of the upward-facing hook (34). The first locking plane is closer to the top of the floor panel than the second locking plane. In the example, the first and second locking planes are adjacent, separated by a bending line (27). The first locking plane and the second locking plane form a concave section (30) of the coupling part to which these locking planes belong.

The locking part of the coupling part (7) on the second edge (3) of the first pair of opposite edges contains a third (23) and a fourth (24) locking plane. In the example, the third (23) and fourth (24) locking planes are adjacent, separated by a bend (29). The third locking plane (23) and the fourth locking plane (24) form a concave section (28) of the coupling part to which these locking planes belong. The first, second, third and fourth locking planes are all located in the lower half of the floor panel thickness (T).

The angle $\gamma_1$ (in the example 47°) between the first locking plane (21) and the surface (15) of the floor panel is smaller than the angle $\gamma_2$ (in the example 60°) between the second locking plane (22) and the surface (15) of the floor panel. The angle $\gamma_3$ (in the example 50°) between the third locking plane (23) and the surface (15) of the floor panel is smaller than the angle $\gamma_4$ (in the example 60°) between the fourth locking plane (24) and the surface (15) of the floor panel. The second locking plane is provided for interaction with the fourth locking plane of a coupled similar panel. The first locking plane is provided for interaction with the third locking plane of a coupled similar panel. Between the first and second locking planes there is an enclosed angle $\alpha$ of 165°. Between the third and fourth locking planes there is an enclosed angle $\beta$ of 172°.

Preferably, the area of the first boundary plane is larger than the area of the second boundary area. In the example, the area of the second boundary plane is 42% of the area of the first boundary plane. The area of the third boundary plane is larger than the area of the fourth boundary plane.

As shown in FIG. 5, the lower lip in coupled condition is partially elastically bent downward, resulting in a clamping force (F) that forces the linked floor panels together. this results in a tension force (F) which ensures that the floor panels are pressed together at or close to the surface of the floor panels.

The first coupling parts of the example are configured so that in coupled condition (see FIG. 5) the horizontal distance (A) between on the one hand the vertical line ($V_1$) through the center in a vertical direction between the first and second locking planes and on the other hand the plane at or near the surface of the coupled panels where the connected panels are sealed together is 5 mm.

When coupling two such floor panels by a tilting motion, the boundary surfaces of the tongue (40) must push against the boundary surfaces on the inside of the upward-facing hook (34). Because the first boundary plane has a lower angle to the surface of the floor panel than the second boundary plane, and because the third boundary plane has a lower angle to the surface of the floor panel than the fourth boundary plane, the contact between the boundary planes of the tongue and boundary planes of the hook is effected later during the coupling process. This reduces the force required to realize this coupling by means of the tilting motion of the tongue (40) in the groove (42). Because of the selection made in the example of the angles between the locking planes and the floor panel surface, in coupled condition there is contact between the second and the fourth locking planes and only just no contact between the first and third locking planes. In the event of a load on the coupling that wants to move the coupled panels apart, distortion of the coupling parts will also cause contact between the first and third locking planes, thus creating the strength of the horizontal coupling.

Figure 7:
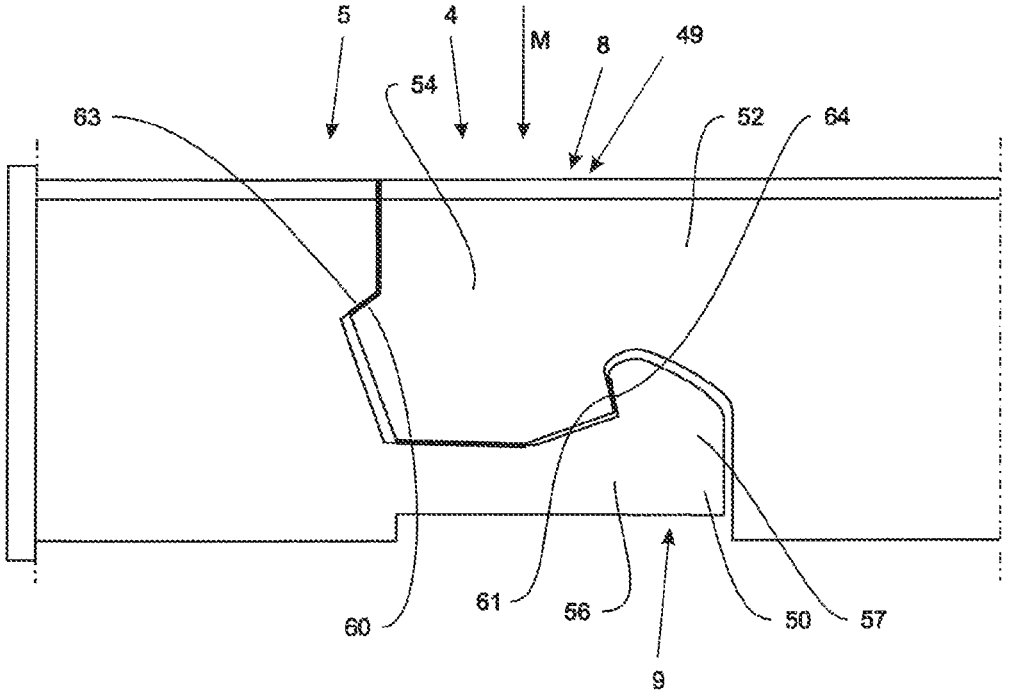
FIG. 7 shows the coupling at the short side of two floor panels as shown in FIG. 1.

FIG. 7 shows the coupling of two floor panels on their short sides according to the example of FIG. 1. For the reference values, please refer to FIGS. 1 and 7. The second pair of opposite edges (4, 5) of floor panel 1 contains second coupling parts (8, 9) that allow several of such floor panels (1) to be coupled together. These second coupling parts (8, 9) constitute a third locking system on the second pair of opposite edges (4, 5) which, in coupled condition of two such floor panels, creates a locking in the plane of the floor panels and perpendicular to the relevant edges, and also a fourth locking system which, in coupled condition of two such floor panels, creates a locking perpendicular to the panels plane. These second coupling parts on the second pair of opposite edges are mainly realized in the material of the floor panel itself, and more in particular in said substrate. The second coupling parts on the second pair of edges are configured to allow two such floor panels to be coupled together on these edges by means of a downward motion of one panel relative to the other.

The third locking system consists of a downward-facing upper hook-shaped section (49) located on one edge of the said pair of opposite edges, and of an upward-facing lower hook-shaped (50) section located on the other opposite edge of said pair of opposite edges. The hook-shaped sections can be hooked together by means of a downward motion (M). The upper hook-shaped part (49) consists of a lip (52) with a downward-facing locking element (54). The lower hook-shaped part consists of a lip (56) with an upward-facing locking element (57).

The downward-facing locking element contains projections (60, 61) that engage in undercuts (63, 64) in the upward-facing locking element of the coupled floor panel.

Figure 8:
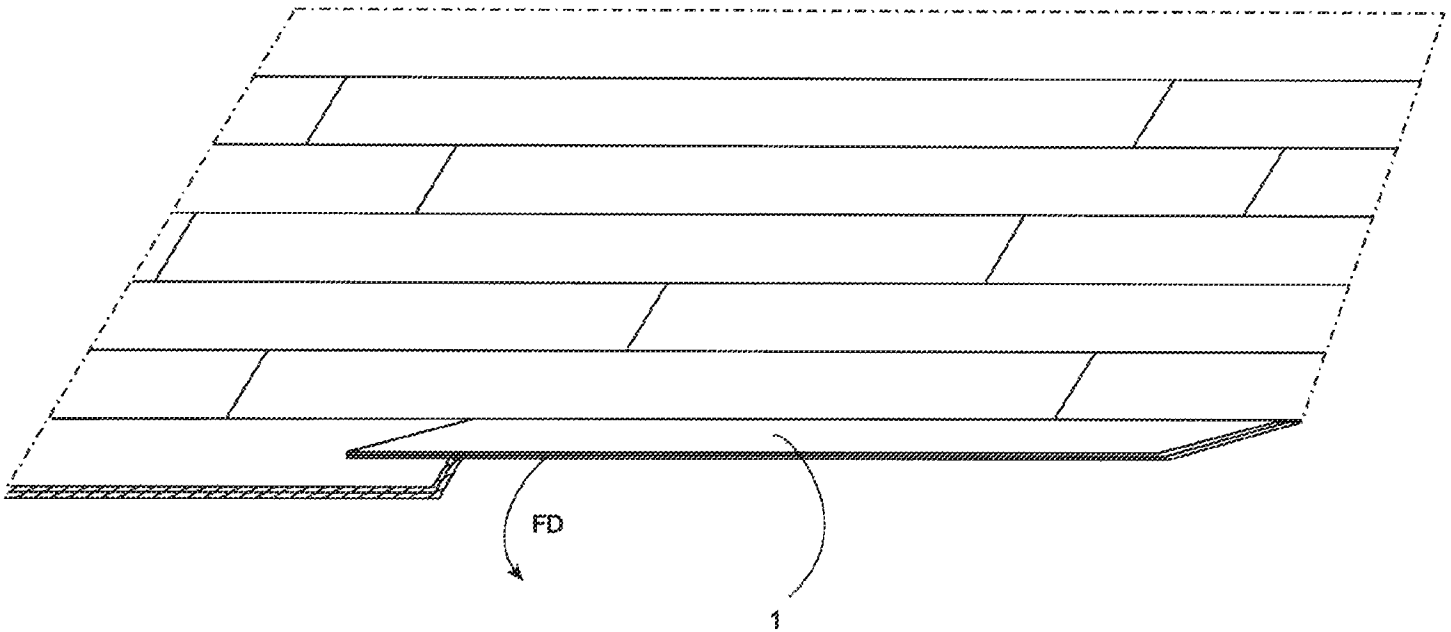
FIG. 8 illustrates how floor panels can be installed to form a floor covering in an embodiment of the invention through a so-called "fold down" motion.

FIG. 8 illustrates how, according to the example of invention described above, floor panels can be installed through a so-called "fold down" (FD) motion into a floor covering. A floor panel 1 has coupling parts at the long side as explained in FIGS. 2, 6 and it has coupling parts at the short side as explained in FIG. 7. At the long side, the floor panel can be coupled by tilting at the long side of floor panels already installed. This floor panel can then be folded down further, while the hooks of the short edges are coupled together by this downward motion. This is referred to as coupling by means of "fold down".

The present invention is by no means limited to the embodiments described above and shown in the figures, but such a floor panel may be implemented in several shapes and dimensions without exceeding the scope of the invention.

For instance, it should be noted that although an oblong panel is shown in FIG. 1, the invention can also be applied in square floor panels. Also, the edges of the first pair of opposite edges in FIG. 1 are identified as the edges 2, 3 of the long sides, but it is clear that by definition the first pair of edges might also be present on the short sides, while the second pair of edges is then present on the long sides.

The invention claimed is:

1. A floor panel for forming a floor covering, wherein this floor panel contains a substrate and a decorative layer;

wherein this floor panel is rectangular, either oblong or square, and contains a first pair of opposite edges and a second pair of opposite edges;

wherein the first pair of opposite edges contain first coupling parts allowing several of the floor panels to be coupled together;

wherein the first coupling parts constitute a first locking system which, in a coupled condition of two such floor panels, creates a locking system in a plane of the floor panels and perpendicular to the edges, and a second locking system which, in a coupled condition of two of such floor panels, creates a transverse lock at the plane of the floor panel;

wherein the first coupling parts are realized mainly in a material of the floor panel itself, and in said substrate;

wherein for a purpose of the first locking system, the first coupling parts contain locking parts which, in the coupled condition, prevent the first coupling parts from being moved apart;

said locking parts are fitted with locking planes;

wherein the first coupling parts comprise a tongue and a groove containing the locking parts, the first coupling parts are arranged for two of such floor panels to be mechanically connected at the edges by horizontal sliding and/or tilting;

wherein at the first pair of opposite edges, the groove is bounded by a lower lip and an upper lip, the lower lip extends sideways beyond a distal end of the upper lip;

wherein the lower lip contains an upward-facing hook at the distal end of the lower lip;

wherein the locking part of the coupling part on a first edge of the first pair of opposite edges contains a first and a second locking plane, wherein the first and second locking planes are adjacent, separated by a bending line or a curved bending plane, wherein the first locking plane and the second locking plane form a convex part of the coupling part to which the locking planes belong;

wherein there is an enclosed angle between the first and second locking planes between 90° and 175° ;

wherein the first and second locking planes are located at an inside of the upward-facing hook;

wherein the locking part of the coupling part on a second edge of the first pair of opposite edges contains a third and a fourth locking plane, wherein the third and fourth locking planes are adjacent, separated by a bending line or a curved bending plane, wherein the third locking plane and the fourth locking plane form a concave part of the coupling part to which the locking planes belong;

between the third and fourth locking planes there is an enclosed angle between 90° and 175°;

wherein the first locking plane is closer to a top of the floor panel than the second locking plane;

wherein the angle between the first locking plane and a floor panel surface is less than the angle between the second locking plane and the surface of the floor panel surface;

wherein the angle between the third locking plane and a floor panel surface is less than the angle between the fourth locking plane and the surface of the floor panel surface;

wherein the second locking plane is provided for interaction with the fourth locking plane of a coupled similar panel;

wherein the first locking plane is provided for interaction with the third locking plane of a coupled similar panel;

wherein the angle between the second locking plane and the floor panel surface is between 48° and 72°; and wherein the angle between the first locking plane and the floor panel surface is at least 10° smaller and less than 20° smaller than the angle between the second locking plane and the floor panel surface.

2. The floor panel according to claim 1, wherein the angle between the third locking plane and the floor panel surface is at least 10° smaller than the angle between the fourth locking plane and the floor panel surface.

3. The floor panel according to claim 1, wherein the first, the second, the third and the fourth locking planes are all located in the lower half of a floor panel thickness.

4. The floor panel according to claim 1, wherein an area of the first locking plane is larger than the area of the second locking plane.

5. The floor panel according to claim 1, wherein an area of the third locking plane is larger than the area of the fourth locking plane.

6. The floor panel according to claim 1, wherein the enclosed angle between the first and second locking planes is smaller than the enclosed angle between the third and fourth locking planes.

7. The floor panel according to claim 1, wherein a difference between the angle between the first locking plane and the floor panel surface, and the angle between the third locking plane and the floor panel surface is greater than the difference between the angle between the second locking plane and the floor panel surface and the angle between the fourth locking plane and the floor panel surface.

8. The floor panel according to claim 7, wherein a difference between the angle between the second locking plane and the floor panel surface and the angle between the fourth locking plane and the floor panel surface is less than 3° in absolute value.

9. The floor panel according to claim 1, wherein the coupling part on the first edge of the first pair of opposite edges contains a horizontal-facing lip, at a bottom of the floor panel, and an upward-facing hook at a distal end of the lip; and wherein the first and the second locking planes are located on an inside of the upward-facing hook.

10. The floor panel according to claim 9, wherein a horizontal line situated vertically in the center between the first and second locking planes is located in the lower half of a distance between the highest point of the upward-facing hook and the lowest point of a top of the lip; and this line is in the lower 40% of the distance between the highest point of the upward-facing hook and the lowest point of the top of the lip.

11. The floor panel according to claim 1, wherein the lower lip in a coupled condition of coupled panels comprising at least two of said floor panel is at least partially elastically bent and provides a clamping force which ensures that the coupled panels are forced together, while the floor panels are pressed together at or close to the floor panel surface.

12. The floor panel according to claim 1, wherein the first coupling parts are configured so that in a coupled condition of coupled panels comprising at least two of said floor panel, a horizontal distance between a vertical line through the center in a vertical direction between the first and second locking planes and the plane at or close to a surface of the coupled panels where the coupled panels are sealed together is less than 5.5 mm.

13. The floor panel according to claim 1, wherein the second pair of opposite edges contain second coupling parts allowing several such floor panels to be coupled together, wherein the second coupling parts at the second pair of opposite edges form a third locking system which, in a coupled condition of two such floor panels, creates a lock in the plane of the floor panels and perpendicular to the edges, and form a fourth locking system which, in a coupled condition of two such floor panels, creates a lock across the panel planes; and wherein the second coupling parts at the second pair of opposite edges are substantially created in the material of the floor panel itself.

14. The floor panel according to claim 13, wherein the second coupling parts at the second pair of edges are configured to allow two such floor panels to be coupled at the edges by a downward motion of one panel relative to the other.

15. The floor panel according to claim 14, wherein said second coupling parts are substantially made up of the material of said substrate and are created as one whole with it, wherein a third locking system is at least formed of a downward-facing upper hook-shaped section located on one edge of said pair of opposite edges, and an upward-facing lower hook-shaped section located on the other opposite edge of said pair of opposite edges, which hook-shaped parts may be hooked together by means of said downward motion;

wherein said upper hook-shaped comprises a lip with a downward-facing locking element, while said lower hook-shaped part consists of a lip with an upward-facing locking element.

16. The floor panel according to claim 15, wherein in a fourth locking system at least one of the second coupling parts comprises one or more projections that engage in one or more undercuts in another of the second coupling parts of the coupled floor panel.

* * * * *